United States Patent [19]

Sawyer

[11] 4,196,239

[45] Apr. 1, 1980

[54] PLANT-LIKE CHEMICAL GROWTHS AND APPARATUS TO DISPLAY SAME

[76] Inventor: George M. Sawyer, 7251 Garden Grove Blvd., #E, Garden Grove, Calif. 92641

[21] Appl. No.: 927,144

[22] Filed: Jul. 24, 1978

[51] Int. Cl.[2] ..... A47G 33/06

[52] U.S. Cl. ..... 428/17; D11/118; 156/61; 206/223; 206/575; 428/19

[58] Field of Search ..... 428/7, 8, 9, 12, 13, 428/18, 19, 20, 15, 17, 139; 215/1 R; 46/1 R; 156/61; D11/118; 206/223, 575

[56] References Cited

U.S. PATENT DOCUMENTS

| | | | |
|---|---|---|---|
| 308,950 | 12/1884 | Chalvin | 428/13 X |
| 1,511,588 | 10/1924 | Bleecker | D11/118 X |
| 1,757,943 | 5/1930 | Mesa | 428/26 X |
| 1,881,423 | 10/1932 | Favreau | 428/19 X |
| 2,067,731 | 1/1937 | Prochazka | 428/13 X |
| 2,128,760 | 8/1938 | Shapiro | 428/13 X |
| 2,129,563 | 9/1938 | Bublitz | D11/118 X |
| 2,760,052 | 8/1956 | Owen | 428/23 X |

*Primary Examiner*—Henry F. Epstein
*Attorney, Agent, or Firm*—William W. Haefliger

[57] ABSTRACT

Plant-like decorative chemical growths are caused to form for display on means such as artificial vegetation.

The means has a lower portion to contact a solution capable of forming the growths when the solution is dried, an intermediate wick portion to feed the solution upwardly, and projecting tips to which the solution is fed to contact dye proximate the tips so that the growths forming proximate the tips may be colored.

12 Claims, 9 Drawing Figures

PLANT-LIKE CHEMICAL GROWTHS AND APPARATUS TO DISPLAY SAME

BACKGROUND OF THE INVENTION

This invention relates generally to plant-like growth displays, and more particularly concerns the formation of decorative chemical growths on a plant-like or tree-like means, at the option of the user or observor.

While crystalline growth on rocks or bricks has been carried out in the past, no prior means to display plant-like chemical growths, as in different colors, and in accordance with the present invention, has been provided, to my knowledge.

SUMMARY OF THE INVENTION

It is a major object of the invention to provide a highly unusual means to effectively and ornamentally display plant-like chemical growths, as for example on simulated vegetation such as plants, trees, etc. Basically, the invention is embodied in such means which comprises:

(a) a lower portion to contact a solution capable of forming the growths when dried, (b) an intermediate wick portion to feed the solution upwardly by wicking action, and (c) projecting tips to which the solution from the intermediate portion is fed to form the growths when the solution fed to the tips is dried.

As will appear, the means embodying the above may include dye on the material at or proximate the tips to color the solution fed to the latter so as to color the growths. The coloring may be different at different tips, to give a surprise factor to the resultant growths.

Further, the tips may be spaced laterally from the intermediate wicking or feeder portion; the material may consist of sheets of wicking material which may have tree-like shape and which may be assembled in a manner to be described; the material may be enclosed within a protective shell, and the tips may project from the end of a shell having tubular shape, or may be exposed at perforations through the shell wall.

These and other objects and advantages of the invention, as well as the details of illustrative embodiment, will be more fully understood from the following description and drawings, in which:

DRAWING DESCRIPTION

FIGS. 1 and 2 are elevations showing sheet form means to display plant-like chemical growths;

FIG. 2*a* is an enlarged elevation of a sheet tip.

DETAILED DESCRIPTION

Figure 1:
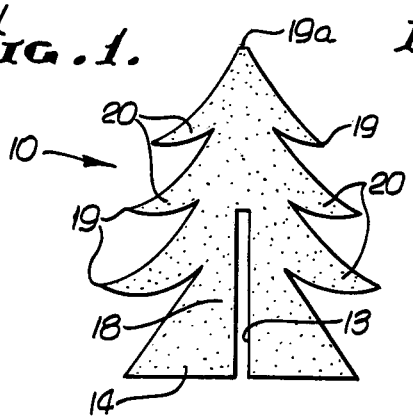
Figure 2:
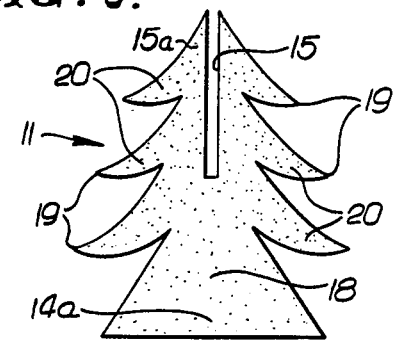
Figure 3:
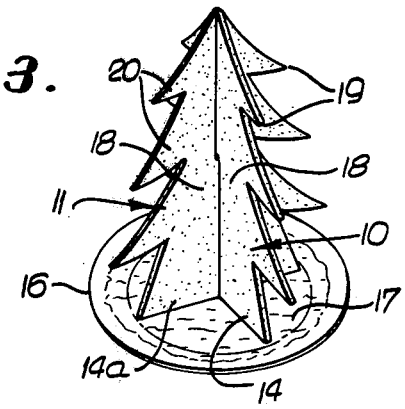
FIG. 3 is a perspective showing the FIGS. 1 and 2 means in assembled condition.

The means illustrated in FIGS. 1–3 include first and second sheets 10 and 11, in evergreen tree shape, capable of interfitting to extend in intersecting planes, as is clear from FIG. 3. Sheet 10 has a vertical slot 13 extending upwardly from its base portion 14, while sheet 11 has a vertical slot 15 extending downwardly from its top portion 15*a*. The slots are sufficiently narrow to allow slide assembly of the two sheets by causing the slot 15 to endwise register with slot 13 and then relatively vertically sliding the sheet together. Slot edges or shoulders on one sheet interfit the other sheet.

FIG. 3 shows the assembled tree with lower or base portions 14 and 14*a* standing in a shallow receptacle 16 to contact a solution 17 capable of forming the growths when the solution is dried. Each sheet 10 and 11 has an intermediate portion 18 that acts as a wick to draw the solution up by capillary action and feed the solution upwardly so that it permeates the sheet. For that purpose, the sheets may consist of dark colored blotter paper material, as for example is produced by Eastman Kodak, Rochester, N.Y.

Also, each sheet has projecting tips to which the solution from the intermediate portion is fed, to form the intended growths when the solution fed to such tips is dried. Note the tips 19 on the ends of laterally tapering tree branches 20, and the tip 19*a* at the tree top. Thus, each sheet or both sheets constitute a means to display plant-like chemical growths.

Figure 2A:
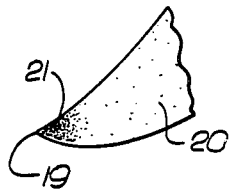
Figure 4:
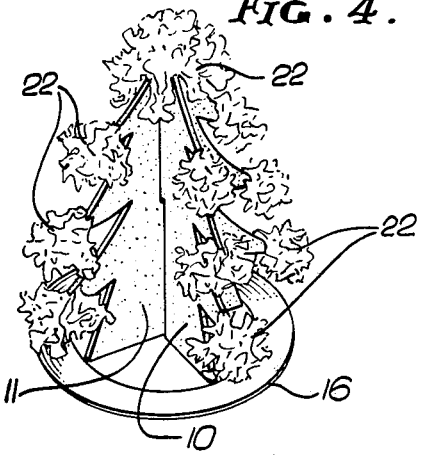
FIG. 4 is an elevation showing the growths that form on the FIG. 3 means.

FIG. 2*a* shows dye 21 impregnating a tip portion of a branch 20, and via which solution passes, by wicking action, to the tip 19. Such dye acts to color the solution passing to the tip, as for example red, blue, white, etc. As a result, the growths that form on the tips, as seen in FIG. 4 at 22, are colored, and a surprise factor results in that the viewer cannot predict the colors of the different growths. Typical dyes are blue and yellow food colorings produced by McCormick & Co., Baltimore, Maryland. Other colors are usable, and these specific dyes are representative only.

Figure 8:
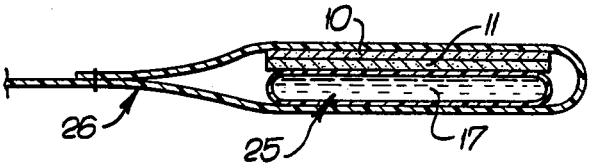
FIG. 8 shows a package to contain the FIGS. 1 and 2 means, plus growth solution in a sealed plastic package.

Referring to FIG. 8, the two sheets 10 and 11 are stored in parallel, adjacent relation, along with a flat, plastic, sealed packet 25 which contains an amount of solution 17 sufficient to grow the growths seen in FIG. 4. The assembly is enveloped by a card or other enclosure 26, for display and/or shipment.

The growths 22 have fine, complex crystalline form, and typically appear frosty. The solution typically consists essentially of an alkaline salt, ammonia, and water. One representative solution to produce the growths is formulated as follows:

- 6 tablespoons of sodium chloride (Morton's)
- 1 tablespoon of ammonia (Star Bros. Colton, California)
- 6 tablespoons of water
- 6 tablespoons of (liquid) laundry bluing (Mrs. Stewart's Liquid Bluing, a product of Luther Ford Products Co., Minneapolis, Minnesota).

The ingredients are thoroughly mixed and enough is poured into the receptacle 16 to maintain the base portions 14 and 14*a* wetted as the growths form.

Figure 5:
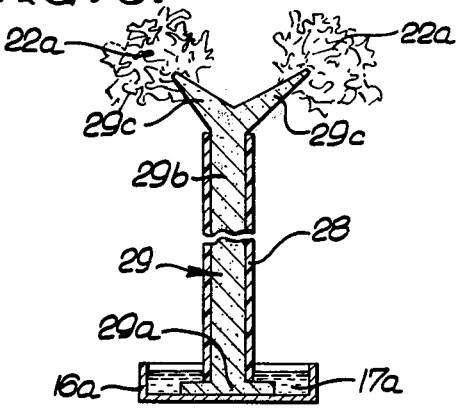
FIGS. 5 and 6 are elevations, in section, showing other forms of the invention.

Another means to display plant-like chemical growth appears in FIG. 5 to have a protective shell 28, in the form of a tube (such as a polyethylene straw), within which the wicking material 29 is filled. The wick has a lower portion 29*a* to contact solution 17*a* in receptacle 16*a*; an intermediate portion 29*b* to feed liquid solution upwardly; and projecting tips 29*c* projecting free of shell 28. Growths 22*a* form on the tips, in a manner similar to growths 22 discussed above, and dye may be located at the tips. The wick 29 may consist of blotter material, fibrous material, cellulosic material, or any other suitable liquid wicking substance.

Figure 6:
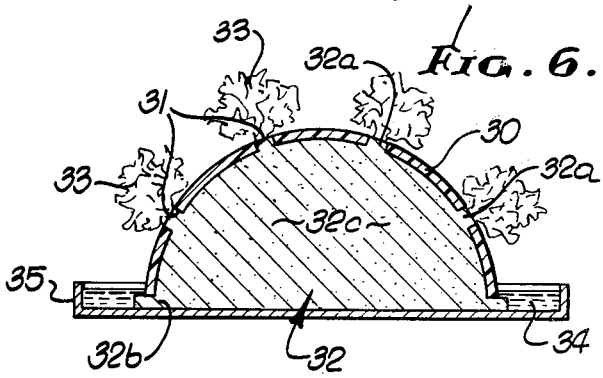

In FIG. 6, the protective shell 30 is dome-like, and contains perforations at 31 to expose the tips 32*a* of the wicking material 32. Solution is fed from the material base or lower portion 32*b* via intermediate portion 32*c* to the tips. Growths 33 form at the tips, as shown, and dye may be located at the tips to color the growths. The solution 34 is contained by receptacle 35.

Figure 7:
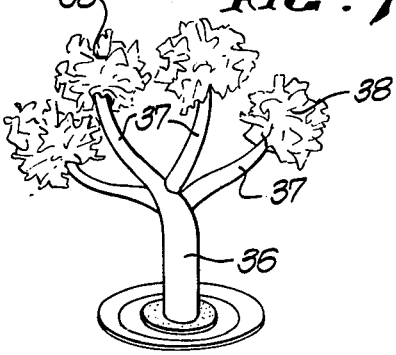
FIG. 7 is an elevation of yet another form of the invention.

In FIG. 7 the display means includes a central trunk 36 and branches 37, with growths 38 at the ends of the branches. The trunk and branches may have the shell and wick construction seen in FIG. 5.

I claim:

1. In means that display plant-like chemical growths, (a) said means having a lower portion to contact a solution capable of forming said growths when the solution is dried, (b) said means having an intermediate wick portion to feed said solution upwardly by wicking action, (c) said means having projecting tips to which said solution from said intermediate portion is fed to form said growths when the solution fed to said tips is dried, and (d) dyes locally impregnating areas of said means in such proximity to the tips as to color the solution fed by said wicking action to the tips and to color said growths.

2. The means of claim 1 having sheet form, and said dye locally impregnating said means at the tips to differentially color the solution fed to the tips and said growths, different of said dyes associated with different of said areas having different color producing characteristics as respects coloring of the growths.

3. The means of claim 2 having the form of a plant, and wherein said tips are spaced generally laterally from said intermediate portion.

4. The means of claim 3 wherein said means comprises first and second sheets which define shoulders that interfit when the sheets are assembled to extend in intersecting planes, whereby said lower portion then defines a base to support the assembled sheets in upright condition.

5. The means of claim 4 wherein the sheets are assembled as defined and have an evergreen-like shape.

6. The means of claim 5 including said growths on said tips.

7. The means of claim 5 including said solution contacting said base.

8. The means of claim 7 wherein the solution consists essentially of an alkaline salt, ammonia and water.

9. The means of claim 1 including a protective shell about said intermediate portion.

10. The means of claim 9 wherein said shell is tubular, and said tips project endwise outwardly of the shell.

11. The means of claim 9 wherein said shell contains perforations to expose said tips at said perforations.

12. The means of claim 4 wherein prior to assembly said sheets extend in parallel stored relation, and including a packet of said solution extending in parallel relation with the sheets, there being an enclosure enveloping said sheets and packet.

* * * * *